United States Patent [19]

Hoersch

[11] 4,365,424

[45] * Dec. 28, 1982

[54] METHOD FOR SURFACE TREATMENT OF AN ENDLESS TEXTILE STRUCTURE

[76] Inventor: Werner Hoersch, Im Brunch 7, 4060 Viersen 11 - Boisheim, Fed. Rep. of Germany

[ * ] Notice: The portion of the term of this patent subsequent to Sep. 1, 1998, has been disclaimed.

[21] Appl. No.: 257,214

[22] Filed: Apr. 24, 1981

Related U.S. Application Data

[62] Division of Ser. No. 127,884, Mar. 6, 1980, Pat. No. 4,286,395.

[30] Foreign Application Priority Data

Mar. 7, 1979 [DE] Fed. Rep. of Germany ..... 2908888

[51] Int. Cl.[3] ..... F26B 3/04

[52] U.S. Cl. ..... 34/23; 34/34; 34/155; 34/156; 68/5 D; 68/DIG. 1

[58] Field of Search ..... 68/DIG. 1, 5 C, 5 D, 68/5 E; 226/118, 119, 97; 34/155, 156, 218, 219, 159, 34, 23

[56] References Cited

U.S. PATENT DOCUMENTS

| | | | |
|---|---|---|---|
| 1,556,057 | 10/1925 | Wheller | 68/DIG. 1 |
| 3,690,128 | 9/1972 | Biesinger | 68/DIG. 1 |
| 4,033,047 | 7/1977 | Kawai | 34/82 |
| 4,286,395 | 9/1981 | Hoersch | 34/155 |

*Primary Examiner*—Larry I. Schwartz

*Attorney, Agent, or Firm*—Roylance, Abrams, Berdo & Farley

[57] ABSTRACT

An endless textile web is processed by passing it through an elongated tubular member defining a treatment zone which is disposed within a chamber. A jet of treatment air is directed against the web near the inlet end of the zone, the jet being directed away from the inlet end to convey the web and cause it to expand and flutter as it moves. Air filtering, treating and blowing steps are included.

9 Claims, 1 Drawing Figure

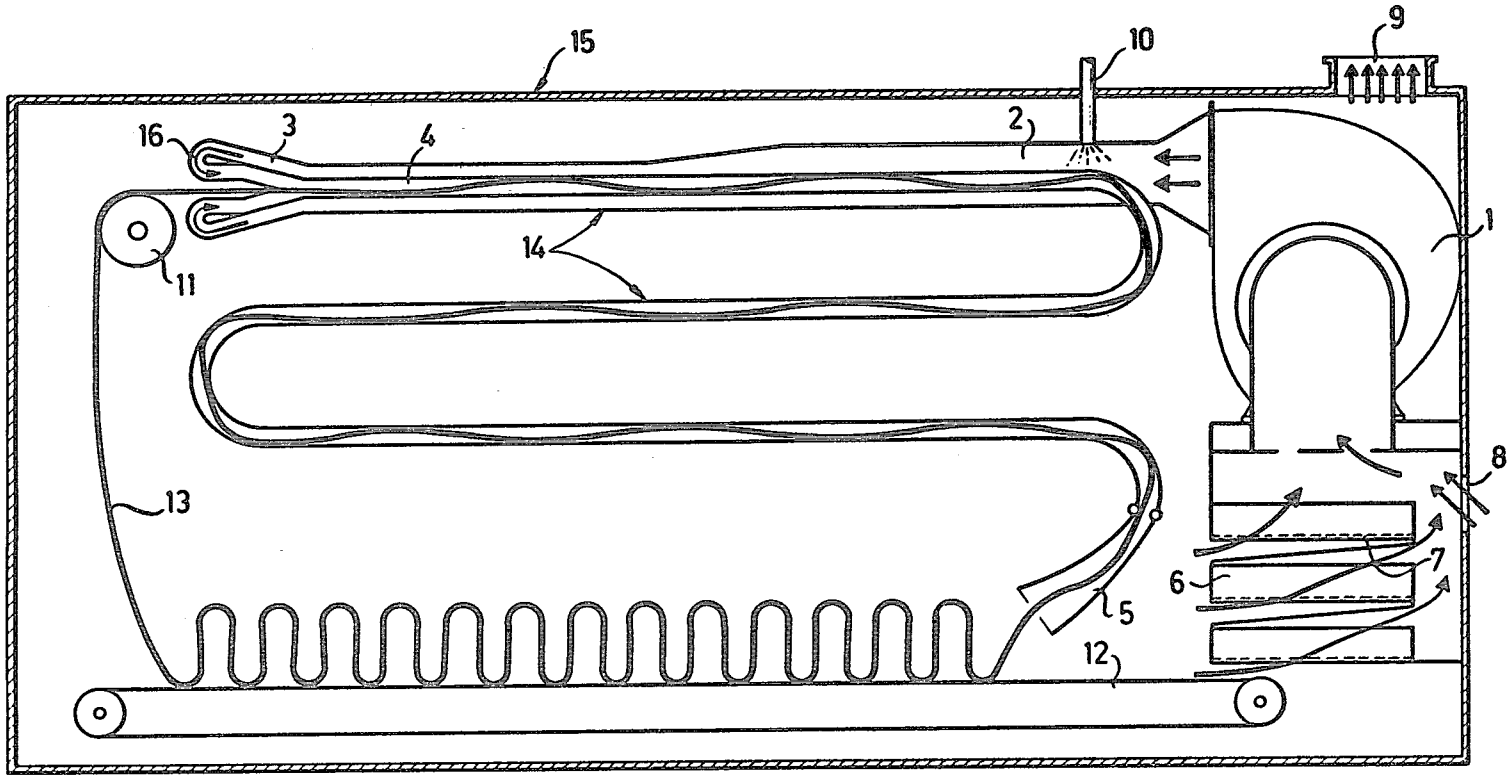
1
2
3
4
5
6
7
8
9
10
11
12
13
14
15
16

METHOD FOR SURFACE TREATMENT OF AN ENDLESS TEXTILE STRUCTURE

This application is a division of application Ser. No. 127,884, filed Mar. 6, 1980, now U.S. Pat. No. 4,286,395.

This invention relates to a process and apparatus for the surface treatment of endless textile structures which can be, for example, in the form of strands.

The textile structure to be treated is pre-dehydrated such as by thorough dripping-out, centrifuging, squeezing out, or by a similar pretreatment. The treatment in accordance with the invention is accomplished by an air current which is caused to impinge upon the textile structure, and the treatment itself is a mechanical surface treatment for purposes of improving the structure.

An object of the invention is to provide a method of surface treating textile structures, even in relatively small batch weights, in an economical fashion.

A further object is to provide an apparatus for surface treatment of small quantities of textile structure such that the investment in equipment is economically advantageous and, additionally, the cost of the treatment processing is itself kept small.

Briefly described, the invention contemplates a process for the surface treatment of an endless textile structure comprising the steps of providing a container having an elongated intensive treatment zone therein, the treatment zone having an inlet end and an outlet end, and being substantially isolated from the container interior, placing the endless textile structure in the container with a portion thereof in the treatment zone, directing a jet of treatment air into the treatment zone near the inlet end directed toward the textile and away from the inlet end to introduce and convey the textile to and through the zone, such that the air impinges on the textile and causes the textile to spread out and flutter in its spread-out form, and receiving the textile at the outlet end of the zone and conveying it to the inlet end for repetitive, continuous treatment thereof.

The invention also contemplates an apparatus for the surface treatment of an endless textile structure comprising a substantially closed container, means defining an elongated treatment channel within said container for receiving and guiding the textile structure, the interior of said channel constituting a treatment zone substantially isolated from the remainder of the container interior, said channel having an inlet end and an outlet end within said container, said inlet end and said outlet end being laterally spaced apart, nozzle means near the inlet end of said channel for directing a stream of air against the textile therein and away from said inlet end to create a current of air longitudinally through the channel for conveying the textile therethrough, blower means coupled to said nozzle means for supplying air under pressure to said nozzle means, conveyor means disposed below said channel for receiving and conveying textile emerging from said outlet end to a location substantially below said inlet end, winch means adjacent said inlet end for receiving said textile from said conveyor means and delivering textile to said inlet end of said channel, and means for driving said winch means.

The actual treatment space consists, in accordance with the invention, of the intensive treatment zone or path and, therefore, a very small space is occupied with the result that the total expenditure is quite low. Additionally, the textile structure, which is commonly a flat-shaped article, is caused to pass through the relatively small space provided and is given an extremely intensive treatment by its intimate contact with the air. The textile structure is conducted in the small space, which is sealed or isolated from the remainder of the interior of the container and is in most intimate contact with the air such that the air current spreads out the textile article, carries it in the spread-out form, and conveys it along the interior of the passage forming the treatment zone, washing around it and penetrating it continuously.

In order that the manner in which the foregoing and other objects are attained in accordance with the invention can be understood in detail, a particularly advantageous embodiment thereof will be described with reference to the accompanying drawing, which forms a part of this specification, and which shows a schematic side elevation of an apparatus in accordance with the invention and illustrating the inventive process.

As shown in the FIGURE, the apparatus includes an elongated conduit or pipeline 2 which is connected to the delivery or output side of a blower 1. Conduit 2 serves as the calming space for the air delivered from the blower. Conduit 2 merges into a nozzle unit 3 which feeds into the inlet end of a smaller interior conduit 4 which constitutes the first section of an intensive treatment stage or zone indicated generally at 14.

The intensive treatment zone 14 terminates, in the illustrated embodiment, at a delivery funnel 5 which is the outlet end of the conduit and which is disposed above one end of a conveyor belt 12. As indicated, the conveyor constitutes a repository to receive the textile structure 13 emerging from the outlet end of the intensive treatment zone. As shown in the drawing, the inlet end of the treatment zone 15 laterally separated from the outlet end, and the conveyor extends from a location below the outlet end to a location below the inlet end so that the textile fabric can be returned for repetitive processing. A winch 11 is provided above the delivery end of conveyor 12 and substantially adjacent the inlet end of the treatment channel and serves to receive textile structure 13 from the conveyor belt and to deliver it to the input at nozzle 3.

The intake side of blower 1, in the embodiment shown, is preferably preceded by a superheater 6 and a filter 7 so that the air emerging from funnel 5 can be recirculated through the blower.

The entire arrangement described is located inside a container 15 which can be provided with an intake vent 8 to bring fresh air from the outside into the interior of the container and an exhaust vent 9 to exhaust air from the interior of the container to the ambient atmosphere. These vents can be provided with controllable ducts to alter the quantity of fresh air taken in and air exhausted.

In order to decrease the overall length of the unit, the first portion of the channel forming the intensive treatment zone 14, including conduit 4 and conduit 2, are produced as a double-wall channel, formed as two concentric tubular members with the outside annular space being connected to the central tube 4 by a deflecting portion 16 which is annular and folds upon itself, causing a reversal in the direction of air flow of approximately 180°. The reversal in direction causes the air flow to be longitudinally along the interior of conduit 4, and against the textile, with the air current flowing toward the outlet end of the channel.

In order to be able to provide the longest possible intensive treatment zone 14, the channel defining this zone can be developed, as shown, as a bent conduit forming a sinuous arrangement with several reversing bends therein.

As schematically indicated at 10, an inlet to conduit 2 can be provided for supplying processing and/or refining agents for the textile structure into the stream of treatment air leading from the blower 1 to nozzle means 3.

It should be noted, in connection with the operation of the device, that a portion of the air, depending upon its state occurring in the course of treatment, may be removable from circulation and replaced by fresh air. The vents 8 and 9 previously described serve this purpose.

In the embodiment shown, the conveyor means forming a repository for the textile structure between the outlet and inlet ends of the treatment zone is shown as an endless revolving conveyor belt 12. However, an alternative device can be an inclined plane sloping downwardly from the outlet end of zone 14 toward a position below the inlet end thereof so that it can serve as a slide for the intermediate textile structure.

However, the use of the endless conveyor belt is preferred because it can be separately driven with the transportation speed controlled such that a uniform delivery of the structure is accomplished and the textile structure can fold as it falls upon the conveyor belt in an accordian fashion, facilitating reacceptance of the textile by winch 11 and delivery to the input end of the treatment conduit.

A significant aspect of the invention lies in the fact that the channel defining the intensive treatment zone 14 has a considerable width, the width being chosen such that the textile structure can be spread out by the air current at least to its full width. Thus, the air current can flow well around the spread-out textile structure, carry and convey it and the textile is thereby permitted to strike against mutually opposite channel walls, which action promotes the surface quality of the textile structure. Insofar as the air current experiences a change of condition in the course of the treatment, which change is possibly disadvantageous or detrimental to the continuing treatment quality, the air may be partly regenerated as by heating, filtering, or the addition of freash air, or the like.

As will be recognized from the drawing, and from the description previously given of the conduits, the nozzle unit can constitute a ring nozzle unit having an annular opening directed toward the textile.

It will also be recognized that it is possible to provide a plurality of intensive treatment zones 14 such as those shown in the FIGURE within a single container, and to provide each such zone with its own blower, filter and heating system.

While one advantageous embodiment has been chosen to illustrate the invention, it will be understood by those skilled in the art that various changes and modifications can be made therein without departing from the scope of the invention as defined in the appended claims.

What is claimed is:

1. A process for surface treating an endless textile structure comprising the steps of placing an endless textile structure in a substantially closed container with a portion of the textile positioned within an elongated intensive treatment zone which is located in the container but which is substantially isolated from the container interior;

directing a jet of treatment air from a blower zone into the treatment zone at an inlet zone thereof, through a nozzle, away from the inlet zone and against the portion of the textile to create a current of air moving in a flow direction longitudinally through the treatment zone, thereby causing the textile to spread out and flutter in its spread-out form and to be conveyed continuously through the treatment zone;

continuously receiving the textile through an outlet zone laterally spaced from the inlet zone and onto a conveyor disposed below the treatment zone as the textile emerges from the treatment zone;

continuously conveying the textile on the conveyor to a location substantially below the inlet zone;

continuously removing the textile from the conveyor; and after removal of the textile from the conveyor, delivering the textile to the inlet zone for repetitive treatment.

2. A process according to claim 1 wherein, after removal of the textile from the conveyor, the textile is transported outside the container upon completion of surface treatment.

3. A process according to claim 1, including returning at least a portion of the air emerging from the outlet zone to the inlet zone.

4. A process according to claim 1, wherein the treatment air is allowed to reach a nonturbulent or calm state before being directed into the treatment zone.

5. A process according to claim 4, wherein the treatment air, in its calm state, is guided in a direction counter to the flow direction in at least a first portion of the treatment zone and is thereafter diverted through substantially 180° for the development of the jet for introduction of the textile into the treatment zone.

6. A process according to claim 1, including removing a portion of the treatment air emerging from the outlet zone from the container and replacing it by fresh air.

7. A process according to claim 1, including heating the treatment air before delivery to the treatment zone.

8. A process according to claim 1, including filtering the treatment air before delivery to the treatment zone.

9. A process according to claim 1, wherein the jet of treatment air is directed into the treatment zone in a ring shape.

* * * * *